US006581836B2

(12) United States Patent
Main

(10) Patent No.: US 6,581,836 B2
(45) Date of Patent: Jun. 24, 2003

(54) APPARATUS AND METHOD FOR AUTOMATIC LID SELECTION IN A PRODUCE PACKING APPARATUS

(75) Inventor: Timothy B. Main, Selah, WA (US)

(73) Assignee: Yakima Packaging Automation, Inc., Yakima, WA (US)

( * ) Notice: Subject to any disclaimer, the term of this patent is extended or adjusted under 35 U.S.C. 154(b) by 0 days.

(21) Appl. No.: 09/898,406

(22) Filed: Jul. 3, 2001

(65) Prior Publication Data

US 2003/0006287 A1 Jan. 9, 2003

(51) Int. Cl.[7] ..... G06K 7/10
(52) U.S. Cl. ..... 235/462.14
(58) Field of Search ..... 235/385, 454, 235/462.14, 462.01; 53/485–491, 476

(56) References Cited

U.S. PATENT DOCUMENTS 5,208,762 A * 5/1993 Charhut et al. ..... 221/9
5,268,849 A * 12/1993 Howlett et al. ..... 141/103
5,377,811 A * 1/1995 Tanaka ..... 198/418.6
6,317,648 B1 * 11/2001 Sleep et al. ..... 53/500
6,332,573 B1 * 12/2001 Gu et al. ..... 235/462.06

* cited by examiner

*Primary Examiner*—Michael G. Lee
*Assistant Examiner*—Lisa M. Caputo
(74) *Attorney, Agent, or Firm*—Davis Wright Tremaine LLP; Michael J. Donohue

(57) ABSTRACT

The present invention automates the process of selecting lids to be inserted over produce containers. In one embodiment, labels are affixed to the bottom container when the selected produce products have been loaded into the container. As the containers move along an assembly line, the label is read and the container directed to a specific lidding station where the desired lid is selected and placed over the container. Multiple lidding stations are provided such that the containers are automatically directed to the appropriate lidding station so that the selected lid may be placed on the container. Alternatively, the system may simply track the movement of containers and count quantities of containers rather than rely on labels affixed to the container. In this manner, containers full of produce are directed to the appropriate lidding stations where lids are automatically selected and positioned over the container.

20 Claims, 5 Drawing Sheets

APPARATUS AND METHOD FOR AUTOMATIC LID SELECTION IN A PRODUCE PACKING APPARATUS

TECHNICAL FIELD

The present invention relates generally to packaging and, more particularly, to an apparatus and method for the automatic selection of a lid in a produce packing apparatus.

BACKGROUND OF THE INVENTION

Produce packing, such as fruit packing, has traditionally been a labor intensive process. Trays of produce, such as apples, are manually filled by workers and delivered to a boxing station in an assembly line. The trays of produce are typically lowered into the box manually. An automated process for tray loading is disclosed in co-pending U.S. application Ser. No. 09/516,821, entitled TRAY LIFT MECHANISM, which is assigned to the assignee of the present application. In this application, an apparatus for automatically loading and unloading the trays of produce is disclosed.

Prior to the loading of trays into boxes, printed symbology, such as a bar code, is attached to the bottom of the box to indicate the contents. At the same location in an assembly line, a lid is automatically assembled and installed over the bottom. That is a flattened lid is automatically extracted from a storage area, formed into a rectangle, and installed over the bottom. It is common in the produce packing industry that the lids for containers of produce are preprinted in advance. The preprinted lids may contain content information, indicating the type of produce in the container and the quality level of produce (e.g., a grade quality designation) and/or the identity of the produce packer or distributor. However, content and quality level may be printed on the lid in a subsequent operation.

In a conventional packing line, the lids and container bottoms are pre-assembled prior to loading the trays of produce into the container. The completed box (i.e., the container bottom and lid) are transported along the assembly line to a packing station where the loaded trays of produce are placed in the container.

At a subsequent location in the assembly line, the lid is sealed and a bar code reader reads the printed symbology to permit a printer to generate a bar code on the outside of the lid to indicate the contents of the box and prior additional size and grade information if required.

The drawback of this process is that only a single type of lid may be used in the assembly line process. Lids are generally provided to the produce packer in a flattened unassembled form. Conventional machinery is used to extract a single lid and to form it into a square or rectangular shape so that it may be positioned to received the loaded box of produce. While such an approach works effectively with a single distributor, most produce packers deal with a large number of distributors, which may be referred to herein as private label distributors or customers. Furthermore, many produce packers must deal with different types of produce and different quality designations for each type of produce. For example, an apple packer may deal with numerous different types of apples as well as different quality grades for each type of apple. Because the lids are preprinted, the produce packer must store sufficient quantities for all the necessary different lid combinations to meet production needs. Because only one lid type is used at a time, automated assembly lines often pre-assemble an excessive number of containers, which are directed to the location in the assembly line where trays of produce are placed in the containers. If the containers have already been packed with fruit, it will be necessary to perform an extra manual step of removing the extra inventory and manually adding the correct lid to the container. This results in labor inefficiencies as well as wasted packing material from lids that must be discarded. In another example, the pre-assembled box (i.e., the container bottom and lid) accumulate in the portion of the assembly line where produce trays are loaded into the containers. If too many boxes have been prepared, it becomes necessary to shut down the assembly line to remove the excess boxes that are no longer required. The produce packer must store the pre-assembled boxes for future use, which requires extra storage space and leads to potential damage of the boxes that are stacked awaiting future use. In addition, the assembly line now must be refilled with pre-assembled boxes (i.e., container bottoms and lids) to correctly indicate the different content and/or private-label customer. This results in inefficiencies in the assembly line process, increased change-over time required to remove the incorrect boxes and replace them in the now empty assembly line with the correct boxes and requires additional storage for pre-assembled boxes that are not currently needed.

Successful operation of a produce packing business with different products and quality types as well as different private label customers requires that different lids be used for different customers and different produce content. Unfortunately, the conventional lidding apparatus is incapable of operation with different types of lids. Therefore, it can be appreciated that there is a significant need for an apparatus and method for the automatic selection of different lid types. The present invention provides this and other advantages as will be apparent from the following detailed description and accompanying figures.

SUMMARY OF THE INVENTION

A fruit packaging apparatus and method automatically tracks containers of fruit and directs each container to a uniquely selecting lidding station where a selected lid is applied to the produce container. In an exemplary embodiment, the apparatus comprises a symbology marker affixed to the container to identify the container. A symbology reader reads the printed symbology and determines therefrom a selected lidding station to which the container will be directed. At the selected lidding station a container lid is automatically placed on the container.

In one embodiment, the symbology marker is a printed symbology, such as a bar code. In this embodiment, the symbology reader is a bar code reader. The symbology may indicate the contents of the container and/or the identity of a distributor of the container.

The apparatus may further comprise a conveyor assembly to transport containers to the selected lidding station. A stop mechanism halts the forward progress of the container at the selected lidding station and allows the container to be moved off of the conveyor assembly for insertion into the selected lid. The complete package, including the container and selected lid, may subsequently be moved back onto the conveyor apparatus for transport along an assembly line.

DETAILED DESCRIPTION OF THE INVENTION

In a conventional produce packing assembly line, container bottoms and lids are pre-assembled prior to loading of trays of produce into the box. The completed boxes are filled with trays of produce at a subsequent point in the assembly line. In contrast, the present invention removes the lidding process to a subsequent point in the assembly line. That is, the trays of produce are loaded into the container bottom and the container lid assembled and placed over the container bottom at a subsequent point in the assembly line. As will be described in greater detail below, barcode labels or other printed symbology is used to identify the type of lid that should be used with each particular container of produce. At the subsequent location in the assembly line, the printed symbology is read and the loaded container of produce directed to a specific station at which the appropriate lid will be assembled and inserted over the loaded container of produce. In this manner, multiple different lids may be automatically selected and processed. This advantageously allows lids to be uniquely selected based on the identify of the private label customer and/or the content of the container.

Figure 1:
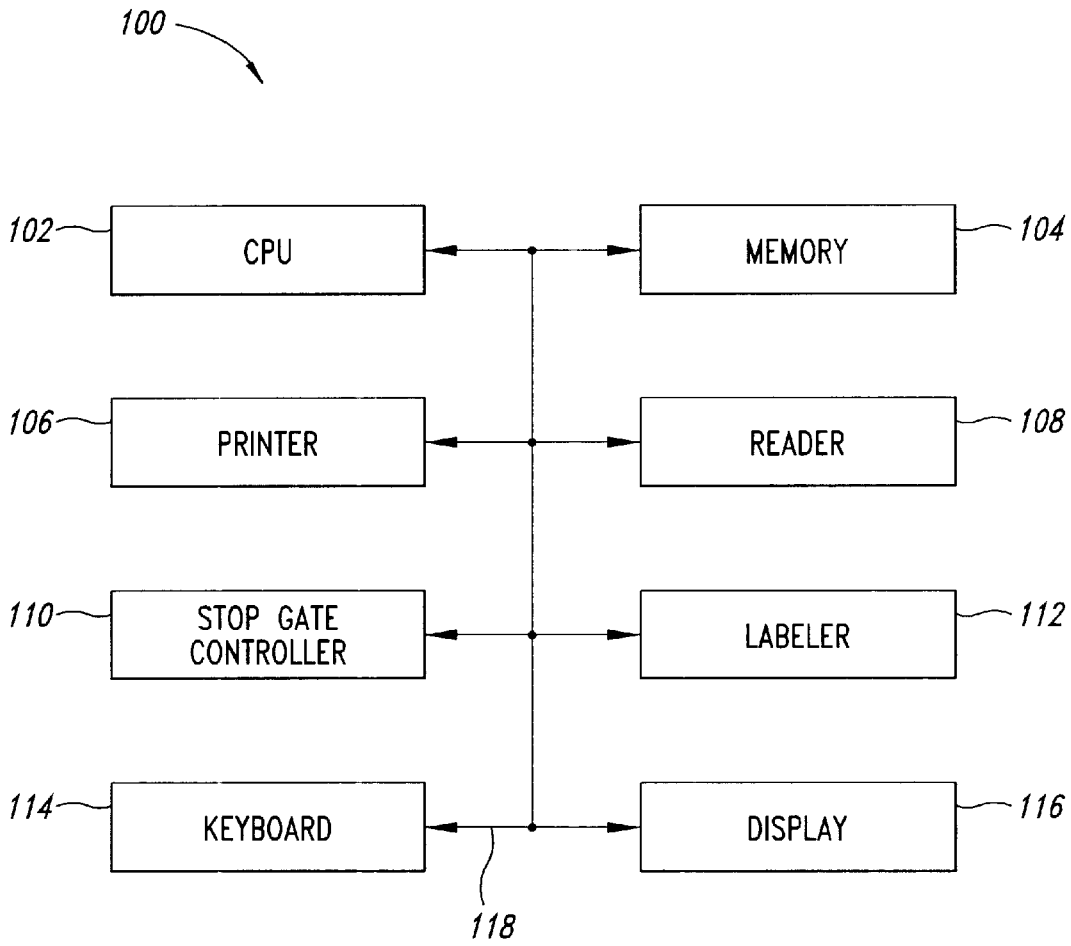
FIG. 1 is a functional block diagram of an exemplary embodiment of the present invention.

FIG. 1 and the following discussion are intended to provide a brief, general description of a suitable computing environment in which the invention may be implemented. Although not required, the invention may be described in the general context of computer-executable instructions, such as program modules, being executed by a personal computer (PC) or other processing device. The invention may be implemented in a distributed computing environment where a single PC controls the generation of printed symbology as well as the subsequent reading of the printed symbology and the selection of the appropriate lid. Alternatively, separate computing devices may be used for the printing and reading processes, respectively.

With reference to FIG. 1, an exemplary system 100 comprises a central processing unit (CPU) 102 and a memory 104. The CPU 102 may be any conventional processing component, such as a microprocessor, microcontroller, digital signal processor program logic array (PLA) or the like. The memory 104 may comprise random access memory (RAM) and read-only memory (ROM). The memory 104 contains instructions and data that control the operation of the CPU 102. The memory 104 may also include a basic input/output system (BIOS), which contains the basic routines that help transfer information between elements within the PC.

Figure 2:
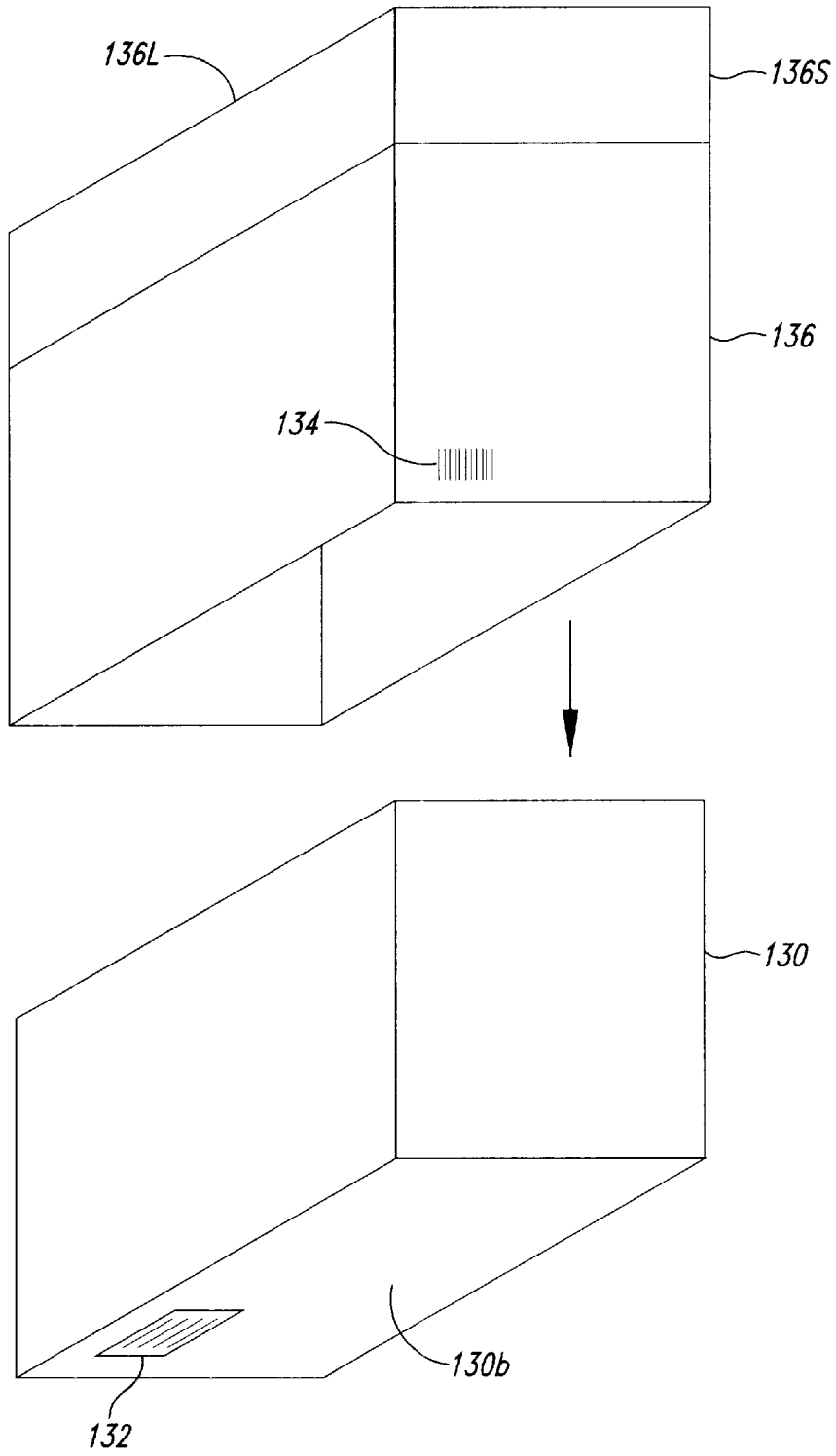
FIG. 2 is an illustration of a typical produce package, including a container bottom and lid.

The system 100 may also include a printer 106, such as a barcode printer, to generate the printed symbologies that may be attached to the container (see FIG. 2). It should be noted that the printer 106 is an optional component that may be included in the system 100, Alternatively, the printer 106 may be a standalone component or part of a different computer system to generate the printed symbologies. In yet another alternative, discussed in greater detail below, the system 100 simply tracks prepackaged containers without the need for printed symbologies.

The system 100 also includes a reader 108, such as an optical scanning barcode reader, to read the printed symbologies and generated digital data representative thereof. The operation of the reader 108 to read printed symbologies is well known in the art, and need not be described in greater detail herein. It is sufficient to state that the reader 108 can read and interpret the printed symbologies and thereby determine the content of the container and/or the identity of the private label customer. Based on the data generated by the reader 108, the system 100 activates assembly line components to direct the full container of produce to a specific lidding station so that the appropriate lid may be placed on the container. As will be described in greater detail below, the system 100 activates one or more stopgates (see FIG. 3) associated with lidding stations to stop the container of produce at the appropriate location in the assembly line. A stopgate controller 110 generates the necessary control signals to activate and deactivate stopgates on the assembly line.

The system 100 may also include an optional labeler 112 which will generate printed symbology, such as barcode labels, that are printed on the outside of the container after the lid is put in place, to further identify the content and/or the private label customer. It should be noted that the labeler 112 is an optional component that may be part of the system 100. Alternatively, the labeler 112 may be separate component and may include an additional reader 108.

The system 100 also typically includes conventional input output devices such as a keyboard 114 and display 116. The keyboard 114 operates in a known manner and allows the produce packer to enter data concerning quantities of containers and to identify the type of lids that are present at each of the lidding stations.

The various components of the system 100 are coupled together by a bus system 118, which may comprise any of several types of bus structures, such as a memory bus or memory controller, peripheral bus, and a local bus using any of a variety of bus architectures. The bus system 118 may also include a control bus and a power bus as well as a data bus and address bus. For the sake of convenience, the various buses are illustrated in FIG. 1 as the bus system 118.

A typical produce package is illustrated in FIG. 2. A container bottom 130 may be preassembled to receive the trays of produce. At an early stage of the assembly line (not shown), the container bottom 130 is loaded with one or more trays of produce. The trays of produce may be manually inserted into the container bottom 130 or may be automatically loaded into the container bottom using, by way of example, the tray loading device described U.S. application Ser. No. 09/516,821.

A printed symbology label 132 is affixed to a bottom panel 130*b* of the container 130. In an exemplary embodiment, the label 132 is a barcode label. However, other types of codes commonly used in packing and shipping industries may also be used satisfactorily with the present invention. The present invention is not limited by the specific form of the label 132. The label 132 may be processed in a number of different manners. For example, the printer 106 (see FIG. 1) may automatically print and apply the label 132 to the bottom panel 130*b* in a conventional manner. In another embodiment, the label 132 may be preprinted and hand applied to the bottom panel 132*b*. In yet another alternative embodiment, preprinted labels 132 may be automatically applied to the bottom panel 130*b*.

FIG. 2 also illustrates a lid 136, sometimes referred to as a sleeve lid. The lid 136 has no bottom portion to permit the lid to fit over the container bottom 130 in a manner described below. The lid 136 has a series of flaps on an upper portion that may be folded over and sealed to form the top portion of the lid. For a rectangular shaped container, illustrated in FIG. 2, the flap portions comprise two opposing short flat sections 136S and two opposing long flap sections 136L. The lid 136 is typically provided to the produce packer in flattened form. As previously noted, a conventional apparatus is used to extract a single lid and form the lid into a square or rectangular shape. However, the conventional lidding process does not permit the selection of differently types of lids, but merely extracts lids and places the container bottoms 130 within the lid 136. In a subsequent operation, the flaps 136S and 136L are folded and sealed. In a conventional packing operation, the printed label 132 indicates the contents of the container bottom 130 and subsequently used to generate a label 134 (e.g., a barcode label) on the outside of the lid 136 once the lid has been applied.

In contrast to the conventional techniques, the present invention uses multiple lidding stations, each of which may contain unique lids indicating the content of the container bottom 130 and/or the identity of the private label customer.

Figure 3:
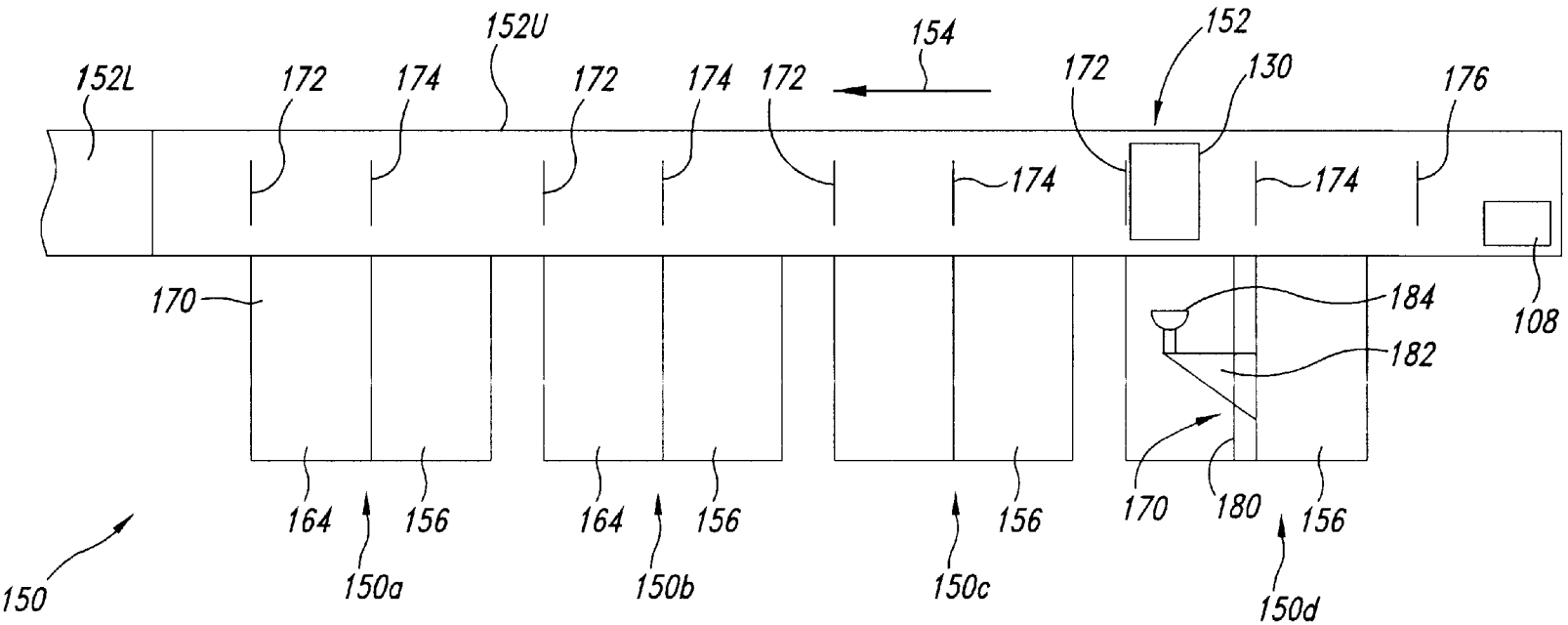
FIG. 3 is a top plan view of one embodiment of the present invention.
Figure 4:
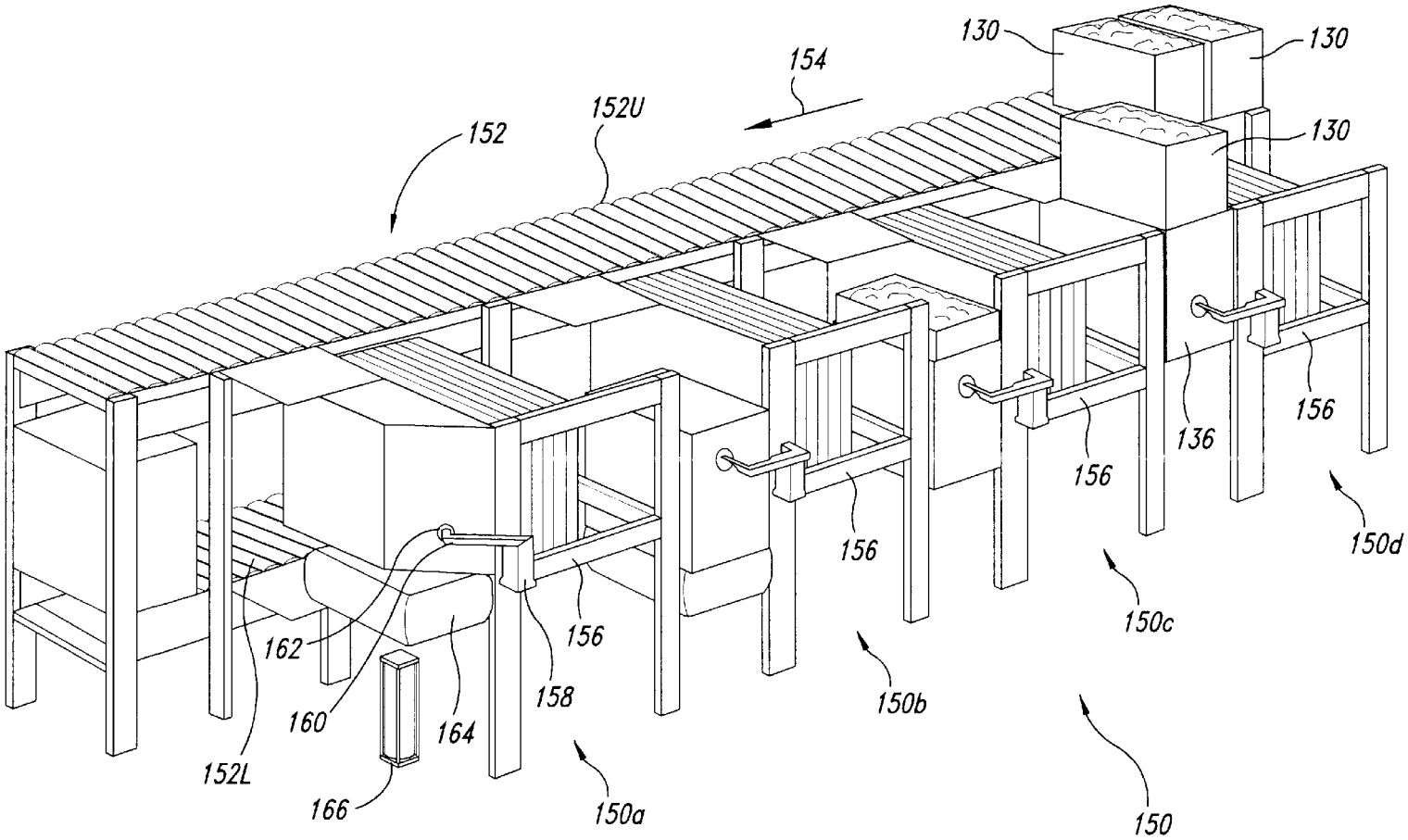
FIG. 4 is a perspective view of one embodiment of the present invention.

FIG. 3 is a top plan view of a lidding apparatus 150 constructed in accordance with the principles of the present invention. FIG. 4 is a prospective view of the lidding apparatus 150. In the example embodiment illustrated in FIGS. 3 and 4, the lidding apparatus 150 comprises four lidding stations 150*a*–150*d*. However, the present invention may operate with as few as two lidding stations and has a maximum number of lidding stations that is limited only by the needs of the produce packer. For example, a four station lidding apparatus 150 may be convenient for small to medium operations while a larger produce packing operation may use ten or more lidding stations. The present invention requires a least two lidding stations, but has no maximum number. The lidding apparatus 150 uses a conveyer assembly 152 to move the packed produce along the assembly line. The conveyor assembly 152 may be any of a number of known devices, such as a conveyer belt, conveyer rollers, and the like. The present invention is not limited by the specific form of the conveyor assembly 152. In the embodiment illustrated in FIGS. 3 and 4, the direction of movement of containers along the conveyor assembly 152 is indicated by an arrow 154. The packed container bottoms 130 come into the lidding apparatus 150 via the conveyor assembly 152. In exemplary embodiment, illustrated in FIGS. 3 and 4, the container bottoms 130 come into the lidding apparatus 150 along an upper conveyor portion 152. As the container bottoms 130 are inserted into lids 136, the entire box (i.e., the container bottom 130 and selected lid 136) are moved onto a lower conveyor portion 152L and transported out of the lidding apparatus 150 along the lower conveyor portion.

Each of the lidding stations 150*a*–150*d* has common components that will be described with respect to FIGS. 3 and 4. Each of the lidding stations 150*a*–150*d* has a lid storage area 156 in which flattened lids 136 (see FIG. 2) may be stored. An actuator 158, such as a motor or other device, is coupled to a frame portion of the lid storage area 156 and rotates to extract flattened lids 136 from the lid storage area. An arm 160 is attached to the actuator 158 at a first arm end and includes an extractor 162, such as a suction cup, at a second arm end. The extractor 162 couples to the flattened container 136 in the lid storage area 156 and, upon rotation of the actuator 158, extracts the folded lid 136 and unfolds the lid to form a square or rectangle. A platform 164, sized to fit through the opening of the lid 136 is moved between a lower position in alignment with a lower conveyor portion 152L or an upper position in alignment with an upper conveyor portion 152U of the conveyor assembly 150. The platform 164 is moved between the lower and upper positions by a drive mechanism 166. The drive mechanism 166 may be hydraulic, pneumatic, or simple mechanical device, such as a screw mechanism or scissors assembly to move the platform 164 to the desired position.

In operation, a lid 136 is extracted from the lid storage area 156 as illustrated at lidding station 150*a* in FIG. 4. The platform 164 is subsequently raised to an upper position in alignment with the upper conveyor portion 150U as illustrated at lidding station 150*d* in FIG. 4. The container bottoms 130, which are loaded with produce, enter the lidding apparatus 150 along the upper conveyor portion 152*u*. As the container bottom 130 enters the lidding apparatus area, the label 132 (see FIG. 2) is read by the reader 108, illustrated in FIG. 3. Based on the data contained in the label 132, the container bottom 130 is directed to one of the lidding stations so that the appropriate lid may be placed on the container bottom.

As illustrated in FIG. 4, the container bottom 130 is moved from the upper conveyor portion 152U by a 90° discharge apparatus 170. The discharge apparatus 170 moves the container bottom 130 onto the platform 164, which has been raised to the upper position in alignment with the upper conveyor portion 152U. The discharge apparatus 170 can be implemented by a variety of different techniques. In one embodiment, shown at the lidding station 150*d* in FIG. 3, the discharge apparatus 170 comprises a guide channel 180 mounted at one side of the lidding station 150*d*. The guide channel 180 may be manufactured from metal, such as aluminum, or other convenient materials. The selection of materials for the guide channel 180 is within the knowledge of one skilled in the art following the teachings contained herein. A support bracket 182 is slidably mounted to the guide channel 180. A suction cup 184 is mounted to the support bracket 182. In operation, the support bracket 182 is driven along the guide channel 180 by a drive mechanism (not shown), such as a motor. The suction cup 184 makes contact with the container 130. As the support bracket (182) moves away from the upper conveyor portion 152U of the conveyor assembly 150, the container 130 is extracted from the assembly line and moved onto the platform 164. A vacuum line (not shown) attached to the suction cup may be used to selectively engage and release the container 130.

It should be noted that the platform 164 has been raised through the lid 136 to reach the upper position in alignment with the upper conveyor portion 152U. Once the container bottom 130 has moved off the conveyor assembly 152, the platform 164 is lowered to its lower position in alignment with the lower conveyor portion 152L, as illustrated at lidding station 150*b* in FIG. 4. In this manner, the container bottom 130 has now been inserted into the selected lid 136. The entire package, including the container bottom 130 and selected lid 136, is moved off the platform 164 onto the lower conveyor portion 152L and transported out of the lidding apparatus 150.

As illustrated in FIGS. 3 and 4, each of the lidding stations 150*a*–150*d* may contain different lids 136 stored in their respective lid storage areas 156. The system 100 directs the container bottom 130 to the appropriate lidding station so that the container bottom may be inserted into the correct lid. The flaps 136S and 136L on the lid are folded and sealed in a different process at a subsequent point in the assembly line. The sealing of the lid flaps 136S and 136L is known in the art, and need not be described herein. In addition, the labeler 112 (see FIG. 1) may generate a bar code label on the outside of the lid 136 in accordance with industry standards. The operation of the labeler 112 is known in the art, and need not be described in greater detail herein. Thus, the system 100 allows the selection of the appropriate lid for each container bottom 130 and selectively places the container bottoms in the appropriate lids.

The container bottoms 130 are directed to the appropriate lidding station and stopped at the selected lidding station using an exit stop gate 172. Each of the lidding stations 150*a*–150*d* has an exit stop gate, which may be a metal tab that pops up through the rollers of the upper conveyor assembly 152U. The exit stop gates 172 may be pneumatically controlled. Alternatively, the exit stop gates 172 may be activated electrically hydraulically, or using conventional electromechancial devices known in the art.

Each lidding station 150*a*–150*d* also includes an entry stop gate 174 to prevent movement of extra container bottoms into a lidding station that might otherwise interfere with operation of the lidding station on a container bottom already present at the lidding station. For example, a first container bottom may be directed to the lidding station 150*d,* while a second container bottom immediately following is intended for lidding station 150*a*. The entry stop gate 174 for the lidding station 150*d* may be temporarily activated to delay entry of the second container bottom 130 into the lidding station 150*d* to permit the first container bottom to be moved from the upper conveyor portion 152U onto the platform 164 at the lidding station 150*d*. In this manner, proper spacing is maintained between container bottoms 130 so that the second container bottom does not physically bump into the first container bottom and interfere with its removal from the upper conveyor portion 152U via the discharge apparatus 170. The entry stop gate 174 is similar or identical in design to the exit stop gate 172. Furthermore, the entry stop gate 174 may be activated in the manner described above. That is, the entry stop gate 174 may be activated pneumatically, hydraulically, electrically, or the like. In an exemplary embodiment, the exit stop gate 172 and the entry stop gate 174 are activated using the same technology (e.g., pneumatic).

The system 100 activates a selected exit stop gate 172 and entry stop gate 174 using the stop gate controller 110. As a container bottom 130 enters the lidding apparatus 150, the label 132 (see FIG. 2) is scanned by the reader 108. If, for example, the label 132 indicates that the container bottom should be directed to the lidding station 150*a,* the stop gate controller 110 (see FIG. 1) will activate the exit stop gate controller 172 at the lidding station 150*a*. The container bottom 130 is directed along the upper conveyor portion 152U in the direction indicated by the arrow 154. The exit stop gate 172 associated with the lidding station 150*a* is activated to prevent the container bottom 130 from moving further down the conveyor assembly 152. When the container bottom 130 arrives at the lidding station 150*a,* the stop gate 172 associated therewith prevents further movement and permits the discharge apparatus 170 to move the container bottom 130 onto the platform 164 so that the container bottom may be inserted into the selected lid 136 at the lidding station 150*a*. The entry stop gate 174 for the lidding station 150*a* may also be activated when the container bottom 130 arrives in the lidding station in the manner described above. Thus, each container bottom 130 is directed to the appropriate lidding station so that it may be inserted into a selected lid 136. Following insertion into the appropriate lid, the entire package, including the container bottom 130 and the lid 136, is moved from the platform 164 onto the lower conveyor portion 152L.

In typical operation, the lidding apparatus 150 inserts container bottoms 130 into the selected lids 136 at a rate that exceeds the rate of movement of container bottoms into the lidding apparatus 150. In some circumstances, it may be necessary to control the flow of container bottoms into the lidding apparatus 150. An entry stop gate 176 at the entry of the lidding apparatus 150 may be temporarily activated prevent movement of container bottoms into the lidding apparatus.

Thus, the system 100 provides a solution to the problem of private labeling and lids that indicate the appropriate contents. The selective lidding process of the system 100 also minimizes the waste of lids that must be removed when conventional packing systems insert container bottoms into the incorrect lids. The system 100 also change over times required to switch from one type of lid to another and minimizes the amount of extra labor that would otherwise required to remove the incorrect boxes from the assembly line and refill the assembly line with the correct boxes. The flexibility provided by an automatic lid selection apparatus of the system 100 accommodates multiple private label customers and different contents within container bottoms. For example, the lidding stations 150*a*–150*d* may contain unique lids 136 for four different private label customers. As the container bottoms loaded with produce enter the lidding apparatus 150, each container bottom is directed to the correct lidding station so that the appropriate lid may be applied for each private label customer.

Alternatively, the various lidding stations 150*a*–150*d* may contain lids to indicate different contents. For example, if the produce being packaged by the system 100 are apples, the different lidding stations may be selected to correspond to different apple types (e.g., red delicious, golden delicious, and the like). In this example, the label 132 (see FIG. 2) indicates the content of the container bottom 130 (i.e., product type) and automatically directs each container bottom to the appropriate lidding station. Thus, the correct lid is automatically selected and applied to the appropriate container bottoms 130. In yet another alternative embodiment, the various lidding stations 150*a*–150*d* may contain lids indicating a selected quality type for a particular product. In the example of apple packing, the different lidding stations may indicate a quality level for apples (e.g., high quality, medium quality, low quality, and the like). In this example, the label 132 (see FIG. 2) indicates the content of the container bottom 130 (i.e., product quality) and automatically directs each container bottom to the appropriate lidding station.

In the examples discussed above, the label 132 (see FIG. 2) is read by the reader 108 and provides the data to direct the container bottom 130 to the appropriate lidding station (e.g., the lidding station 150*a*–150*d*). The label 132 is presently used in conventional systems and thus may be readily applied to the present invention for use in directing each container bottom to the appropriate lidding station. However, in an alternative embodiment, the system 100 can track the container bottoms 130 without the need for the label 132. Instructions may be provided to the system 100, via the keyboard 114 (see FIG. 1), to indicate that a predetermined number of container bottoms should be directed to lidding station 150*a,* a second predetermined of container bottoms that are directed to lidding station 150*b,* and so forth. In this example, the system 100 merely tracks the number of container bottoms 130 that are directed to each lidding station so as to properly fill the order for each private label customer. For example, a first customer may order 1,000 boxes of produce while a second customer has ordered 500 boxes of the same produce. The user enters data via the keyboard 114 to cause the system 100 to direct the first 1,000 container bottoms 130 to, by way of example, lidding station 150*a* while the subsequent 500 container bottoms are directed to, by way of example, lidding station 150*b*. Those skilled in the art can appreciate that other sequencing techniques may also be used. For example, the system may alternate loading the first 1,000 container bottoms 130 between lidding stations 150*a* and 150*b* such that both orders are filled at the same time. Following the first 1,000 container bottoms, the order from the second customer has been filled (i.e., 500 boxes of produce), but only half the order from the first customer has been filled (i.e., 500 boxes out of 1,000 boxes). Thus, the system 100 may direct the next 500 container bottoms 130 to the lidding station 150*a* until the first customer order is completely filled. This implementation of the system may be useful when a large quantity of the same product type is being packed for multiple private label customers.

Figure 5:
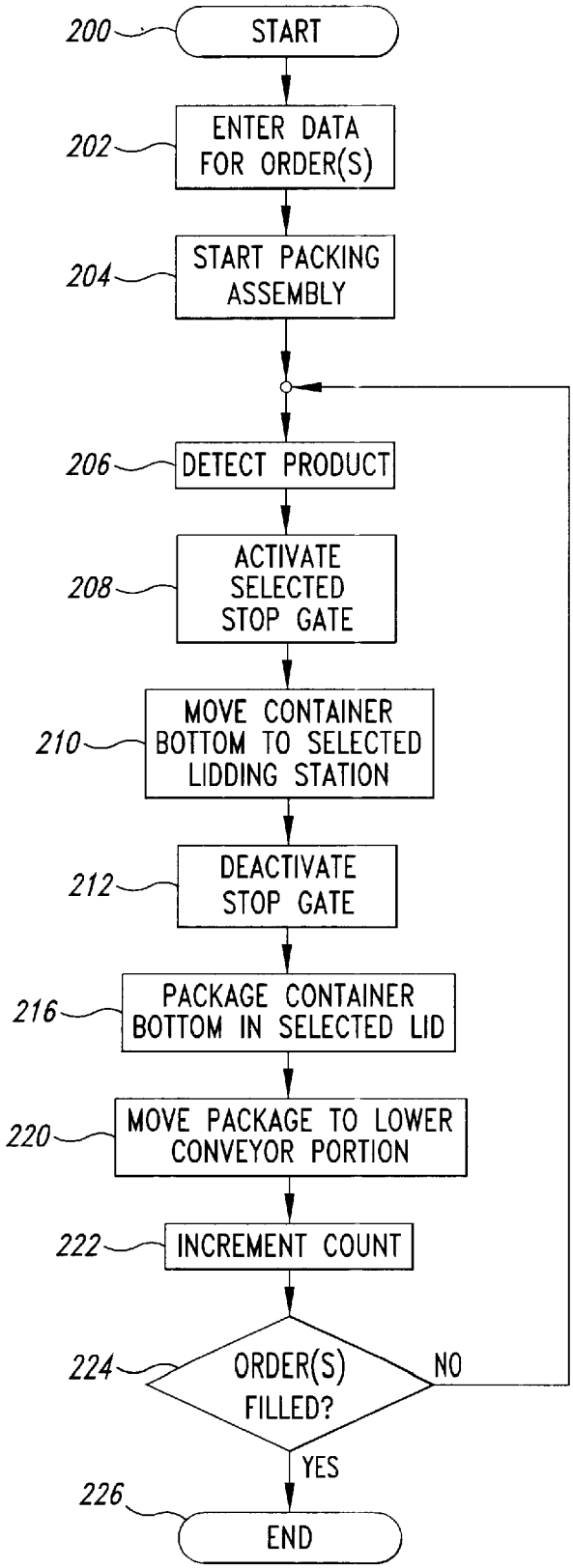
FIG. 5 is a flowchart illustrating the operation of the present invention.

The operation of the system 100 to automatically select lids for individual container bottoms is illustrated in the flowchart of FIG. 5 where the operation starts at 200. In step 202, the user enters data for orders via the keyboard 114 (see FIG. 1) or other conventional computer input device (not shown). The data may comprise information such as the quantity of container bottoms 130 to be packaged for individual ones of private label consumers and/or content identification (e.g., produce type or quality grade) for a particular private label customer. In step 204, the system starts the packing assembly. As noted above, the present invention does not relate to specific techniques for packing produce into the container bottoms 130. This process may be done manually using conventional techniques or automatically using techniques, such as those disclosed in U.S. patent application Ser. No. 09/516,821 described above.

In step 206, the system 100 detects the appearance of a container bottom 130 at the lidding apparatus 150 (see FIGS. 3 and 4). In step 208, the system activates a selected stop gate 172 (see FIG. 3) at one of the lidding stations (e.g., the lidding stations 150*a*–150*d*). As previously discussed, the selected stop gate may be activated based on, by way of example, the label 132 (see FIG. 2) affixed to the bottom panel 130*b* of the container bottom 130. Alternatively, the system may track the container bottom simply by counting the quantity of containers rather than relying on the label 132. In either case, a selected stop gate 172 is activated by the system in step 208.

In step 210, the system 100 moves the container bottom 130 to the selected lidding station (e.g., one of the lidding stations 150*a*–150*d*) using the discharge apparatus 170 (see FIG. 3). At this point, the container bottom 130 has been moved off of the upper conveyor portion 152U, which may now be used to transport additional container bottoms to other lidding stations. In step 212, the system 100 deactivates the selected stop gate to permit the free flow of container bottoms along the upper conveyor portion 152U.

In step 216, the container bottom is packaged in the selected lid. In the example illustrated in FIGS. 3 and 4, the platform 164 is raised into alignment with the upper conveyor portion 152U to receive the container bottom 130. As the platform 164 is lowered into alignment with the lower conveyor portion 152L, the container bottom is simultaneously inserted into the selected lid 136. Thus, upon completion of step 216, the container bottom 130 has been automatically placed into a selected lid 136. In step 220, the entire package, comprising the container bottom 130 and the selected lid 136, is moved from the platform 164 onto the lower conveyor portion 152L and moved out of the lidding apparatus 150 along the lower conveyor portion.

In step 222, a system increments the count of containers from the selected lidding station. In the example presented above, 1,000 container bottoms 130 are to be packaged for a first private label customer at lidding station 150*a* (see FIGS. 3 and 4) and 500 container bottoms are to be packaged for a second private label customer at lidding station 150*b* for a second private label customer. As each box (i.e., the container bottom 130 and selected lid 136) leave the lidding station and are placed on the lower conveyor portion 152*l*, a count for that lidding station is incremented to indicate that part of a previously entered order has now been filled.

In decision 224, the system 100 determines whether the order or orders have been completely filled. In the event that the orders have not been filled, the result of decision 224 is NO. In that event, the system 100 returns to step 206 to detect additional products entering the lidding apparatus 150 via the upper conveyor portion 152U and to direct them to the appropriate lidding stations (e.g., the lidding stations 150*a*–150*d*). When one or more of the orders has been filled, container bottoms 130 will no longer be directed to the associated lidding station. However, additional container bottoms 130 may be directed to other lidding stations for orders that have not yet been filled. At some point in time, all orders will be filled. In that event, the result of decision 224 is YES and the system 100 ends the process at 226. Thus, the present invention automatically tracks and selects the appropriate lid 136 for insertion over container bottoms 130 such that the lids may be used to reflect the content of the package and/or the identity of the private label customer.

It is to be understood that even though various embodiments and advantages of the present invention have been set forth in the foregoing description, the above disclosure is illustrative only, and changes may be made in detail, yet remain within the broad principles of the invention. Therefore, the present invention is to be limited only by the appended claims.

What is claimed is:

1. A produce packaging apparatus, comprising:

a produce packing device to load a shipping container with produce;

a symbology marker affixed to the container;

a conveyor assembly to transport the loaded container;

a lidding apparatus comprising a plurality of lidding stations, the plurality of lidding stations each containing different lids indicative of different contents that may be in the produce container; and a symbology reader to read the printed symbology on each container and determine the contents of each container therefrom, the conveyor assembly directing the container to a selected one of the plurality of lidding stations containing lids corresponding to the contents of each container based on the printed symbology to permit a lid contained at the selected lidding station to be placed on the container wherein the selected lid indicates the contents of the container.

2. The apparatus of claim 1 wherein the symbology marker is a printed symbology.

3. The apparatus of claim 1 wherein the symbology marker is a printed bar code symbol.

4. The apparatus of claim 3 wherein the symbology reader is a bar code reader.

5. The apparatus of claim 1 wherein the printed symbology identifies a distributor of the container.

6. The apparatus of claim 1 wherein the conveyor assembly comprises a roller conveyor.

7. The apparatus of claim 1, further comprising a selectively activated stop mechanism associated with each of the lidding stations to permit the movement of the container from the conveyor assembly to the selected lidding station when the stop mechanism associated with the selected lidding station is selectively activated.

8. An automatic lidding apparatus to place a lid on a shipping container, comprising:

a conveyor assembly to transport the container;

a plurality of lidding stations, the plurality of lidding stations each containing different lids corresponding to different products that may be in the container;

a processor to track movement of the container and to control movement of the container to a selected one of the lidding stations containing lids corresponding to the contents of the container; and a selectively activated stop mechanism associated with each of the lidding stations to permit the movement of the container from the conveyor assembly to the selected lidding station when the stop mechanism associated with the selected lidding station is selectively activated by the processor.

9. The apparatus of claim 8 wherein the conveyor assembly comprises a roller conveyor.

10. The apparatus of claim 8, further comprising a symbology marker affixed to the container and a symbology reader positioned in proximity with the conveyor assembly to read the symbology and determine therefrom a selected container lid, the processor activating the selected stop mechanism based on the symbology to thereby direct the container to the selected lidding station.

11. The apparatus of claim 10 wherein the symbology marker is a printed symbology.

12. The apparatus of claim 10 wherein the symbology marker identifies a distributor of the container.

13. The apparatus of claim 10 wherein the symbology marker is a printed bar code symbol.

14. The apparatus of claim 13 wherein the symbology reader is a bar code reader.

15. A method for automatic lid selection on a shipping container, comprising:

transporting the container to a lidding area on conveyor assembly;

storing a different lid at each of a plurality of lidding stations for placement on the container with each lid corresponding to different contents that may be present in the container;

tracking movement of the container along the conveyor assembly and controlling movement of the container to a selected one of the plurality of lidding stations having a lid corresponding to the contents of the container; and moving the container from the conveyor assembly to the selected lidding station to permit the application of the stored lid corresponding to the contents of the container.

16. The method of claim 15, further comprising reading a symbology marker affixed to the container wherein controlling movement from the conveyor assembly to the selected lidding station is based on the symbology.

17. The method of claim 16 wherein the symbology marker is a printed symbology.

18. The method of claim 16 wherein the symbology marker identifies a distributor of the container.

19. The method of claim 16 wherein the symbology marker is a printed bar code symbol.

20. The method of claim 19 wherein reading the symbology marker comprises reading the bar code symbol.

* * * * *